United States Patent [19]

McIntyre

[11] Patent Number: 5,029,343

[45] Date of Patent: Jul. 9, 1991

[54] ATHLETIC SHIRT

[76] Inventor: Wade A. McIntyre, 6589 Woodmere Dr., Walkertown, N.C. 27051

[21] Appl. No.: 483,392

[22] Filed: Feb. 22, 1990

[51] Int. Cl.[5] ..... A41B 1/00; A41B 1/08

[52] U.S. Cl. ..... 2/115; 2/46; 2/DIG. 6; 224/901

[58] Field of Search ..... 2/46, 75, 80, 90, 91, 2/92, 94, 105, 106, 113, 114, 115, 118, 119, 120, DIG. 6; 224/901

[56] References Cited

U.S. PATENT DOCUMENTS

| | | | |
|---|---|---|---|
| 1,238,070 | 8/1917 | Weisel | 2/106 |
| 1,594,541 | 8/1926 | Mandell | 2/91 |
| 1,629,840 | 5/1927 | Rolnick | 2/91 |
| 2,272,041 | 2/1942 | Pocock | 2/94 |
| 2,549,494 | 4/1951 | Licht | 2/106 |
| 2,556,039 | 6/1951 | Landert | 2/106 |
| 2,685,690 | 8/1954 | Chrisman | 2/115 X |
| 3,031,677 | 5/1962 | Murphy | 2/91 X |
| 3,760,461 | 9/1973 | Wright | 224/901 X |
| 4,078,265 | 3/1978 | Condit | 2/115 |
| 4,277,848 | 7/1981 | Boehland | 2/115 |
| 4,296,498 | 10/1981 | Vinson | 2/115 |
| 4,403,366 | 9/1983 | Lucke | 224/901 |
| 4,449,252 | 5/1984 | Sullinger | 2/46 |
| 4,601,066 | 7/1986 | Campbell | 2/79 |
| 4,638,595 | 8/1987 | Cash | 2/105 |
| 4,698,854 | 10/1987 | Slimmon | 2/48 X |
| 4,754,500 | 7/1988 | Brucato et al. | 2/105 |
| 4,768,236 | 9/1988 | Klob | 2/115 X |
| 4,771,478 | 9/1988 | Bisagno et al. | 2/211 X |

*Primary Examiner*—Werner H. Schroeder
*Assistant Examiner*—Jeanette E. Chapman

[57] ABSTRACT

An athletic shirt having a towel-like appendage attached proximate the neck opening on the back of the shirt provides a useful and convenient accessory for tennis players, golfers or other athletes. A towel-like member, by being freely suspended from the shirt allows the user to conveniently wipe his hands or clean sports equipment thereon without having to delay play. As the device is suspended on the back of the athlete's shirt, it remains out of the way during games yet can be easily reached when needed.

12 Claims, 1 Drawing Sheet

ATHLETIC SHIRT

BACKGROUND OF THE INVENTION

1. Field Of The Invention

The invention herein pertains to athletic garments and specifically to shirts as may be worn by golfers, hand ball and tennis players and others. The invention includes a wiping towel which is an integral part of the shirt and is attached for convenience and efficient use for the wearer during play.

2. Description Of The Prior Art And Objectives Of The Invention

Tennis players and other athletes who utilize hand held rackets, paddles or other tools or players who use their hands during games oftentimes must pause while they locate a cloth, towel or rag to clean their hands of perspiration and dirt. For example, during a tennis match, a player frequently stops to walk to the sideline to pick up a towel to wipe his hands. Football quarterbacks many times require the center to insert a towel in the rear waist band so a wiping surface will be available to the quarterback before the ball is snapped. Wide receivers, kickers and others in football utilize towels suspended from the waist of their pants to provide a convenient hand or shoe wiping surface. These towels oftentimes become dislodged and even can become obstacles in the way of the athlete's performance and accordingly use thereof has not become widely adopted.

With the disadvantages and problems associated with the use of prior art wiping devices for athletes, the present invention was conceived and one of its objectives is to provide an athlete with a shirt which will include a towel-like member conveniently affixed thereto.

It is another objective of the present invention to provide an athletic shirt which will allow the athlete easy access to towel-like member, yet which will remain out of the way during play.

It is still another objective of the present invention to provide an absorbent towel-like member which is releasably attached at one end at the rear of the neck of the shirt and is freely suspended for convenience during use.

Various other objectives and advantages of the present invention become apparent to those skilled in the art as a more detailed description is presented below.

SUMMARY OF THE INVENTION

The invention herein pertains to an athletic shirt and specifically to a shirt having an attached towel-like absorbent member. The shirt can be worn while playing games such as tennis and the absorbent member, by being attached proximate the neck on the back of the shirt, is freely suspended therefrom whereby the athlete can reach behind and grasp the absorbent member to wipe his hands, or use the member to wipe a golf club head or the like. By being positioned on the back of the shirt the absorbent member does not impede the mobility or motion of the athlete but remains conveniently positioned out of the way during play and readily available during play stoppage.

DESCRIPTION OF THE PREFERRED EMBODIMENT

Figure 1:
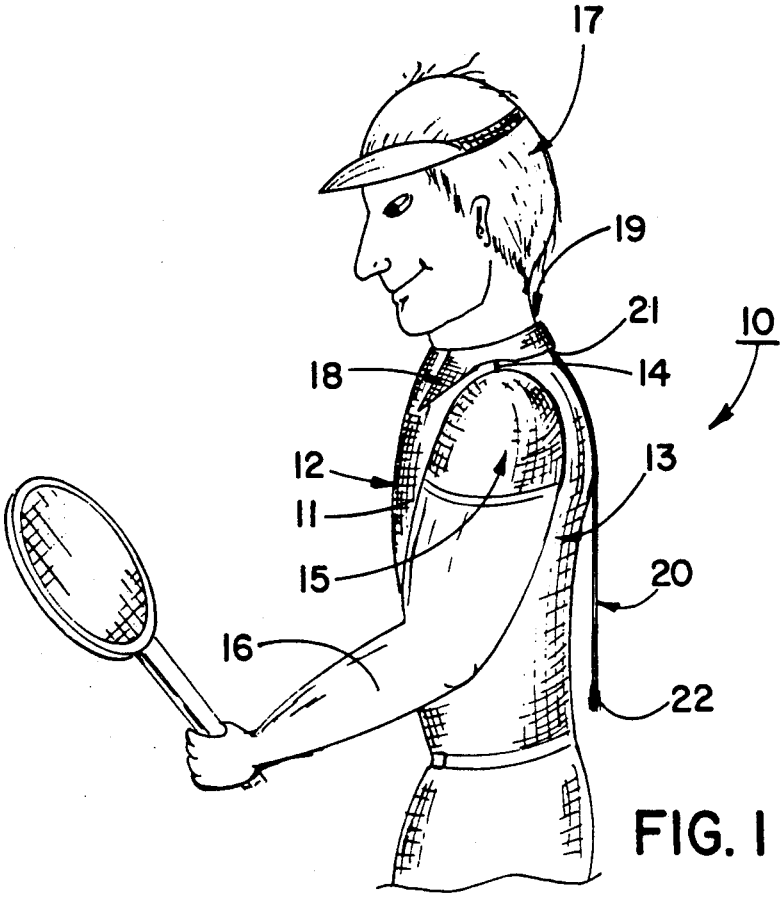
FIG. 1 demonstrates the invention in the form of an athletic shirt as may be worn by a tennis player showing an absorbent towel-like member attached to the rear portion of the shirt proximate the neck opening.
Figure 2:
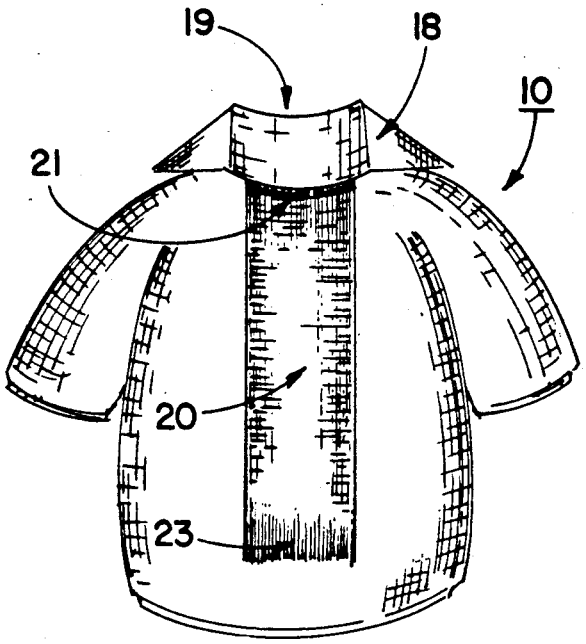
FIG. 2 is a rear elevational view of the athletic shirt as shown in FIG. 1 with the absorbent member sewn thereto.

The preferred form of the invention is shown in FIGS. 1 and 2 which comprises a conventional cotton knit sport shirt having sleeves and a collar. The absorbent member is sewn into the back body portion of the shirt at approximately the neck, and consists of a rectangular terry cloth appendage which extends downwardly along the back of the shirt to the approximate waist area. The towel-like appendage or member for a medium size man's shirt is approximately seven (7) inches wide, twenty-four (24) inches long and consists of a single layer of cotton terry cloth fabric. The towel-like member includes a bottom fringe for decorative purposes and is of sufficient length to be easily grasped by a player as needed yet remains out of the player's vision and way during play.

DETAILED DESCRIPTION OF THE DRAWINGS AND OPERATION OF THE INVENTION

Turning now to the drawings, for a more detailed explanation of the invention and its use, FIG. 1 depicts athletic shirt 10 having a body portion 11 which is generally divided into a front section as indicated by arrow 12 and a rear body section indicated by arrow 13. As would be understood shoulder seam 14 divides body portion 11 into front and back sections. Sleeve 15 provides an opening for arm 16 of player 17. Athletic shirt 10 also includes a sewn in collar 18 which surrounds the neck opening, generally indicated by arrow 19. Absorbent member 20 has its proximal end 21 sewn in neck opening 19 of body portion 11 and distal end 22 is freely suspended to approximately the waist of the wearer. Absorbent member 20 may be formed from a single ply of terry knit cotton yarn and extends downwardly beyond the midpoint of shirt 10 as seen in FIG. 1 and 2 to approximately the waist area of the wearer as also seen in FIGS. 1 and 2. Fringe 23 as shown in FIG. 2 provides a decorative touch to absorbent member 20. The attachment of proximal end 21 to shirt 10 can be better seen in FIG. 2 with collar 18 raised, thus exposing sewn proximal end 21.

Figure 3:
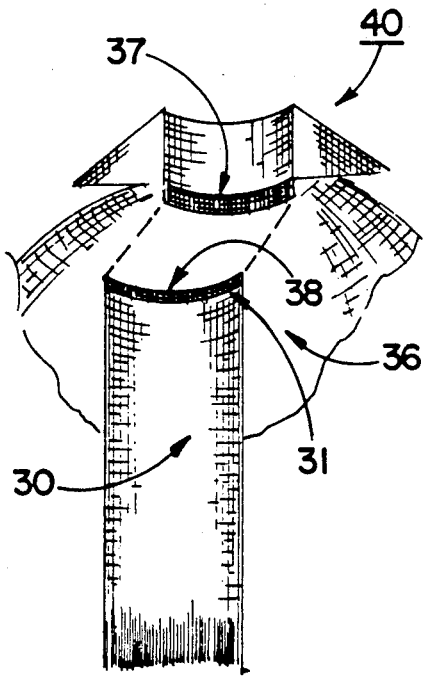
FIG. 3 is another embodiment of the athletic shirt with the absorbent member releasably attached by hook and loop fasteners.

Another embodiment of the invention is shown in FIG. 3 whereby rear section 36 of shirt 40 includes a hook and loop assembly (such as trademarked "Velcro") for absorbent member 30. As would be understood, the hook and loop fastening means has a male (hook) portion 37 affixed at the rear neck area of shirt 40 and a female (loop) portion 38 which is affixed to the proximal end 31 of absorbent member 30. In this particular embodiment, absorbent member 30 can be easily removed for example, when the shirt is not worn for athletic events, but instead is worn for casual wear. Other means to releasably attach member 30 to shirt 40 such as snaps, buttons, zippers, adhesives or the like may also be used as desired under certain circumstances.

The player can grasp distal end 22 of member 20 as seen in FIG. 1 and can pull it to the front under an arm, or can "flip" it over his shoulder for wiping his hands, racket handle or the like. After use it can easily be returned to its original suspended position on the back of shirt 10.

The illustrations and examples provided herein are for explanatory purposes and other types of shirts or jerseys could likewise be used with the absorbent member and the examples herein and are not intended to limit the scope of the appended claims.

I claim:

1. An athletic shirt having a body portion having a back and a front with neck and arm openings, the improvement comprising: an elongated absorbent member, said member having a proximal and a distal end, said proximal end attached to said shirt at the back of said neck opening to extend freely downwardly along the back past the midpoint of said body portion, wherein said absorbent member is releasably attached on the outside of said neck opening.

2. An athletic shirt as claimed in claim 1 wherein said absorbent member extends downwardly beyond said arm opening.

3. An athletic shirt as claimed in claim 1 wherein said absorbent member is rectangularly shaped.

4. An athletic shirt as claimed in claim 1 wherein said absorbent member is formed from terry cloth.

5. An athletic shirt as claimed in claim 1 wherein said absorbent member is formed from knitted cotton yarn.

6. An athletic shirt as claimed in claim 1 wherein said absorbent member is sewn to said body portion.

7. An athletic shirt as claimed in claim 1 wherein said absorbent member is attached to said body portion by hook and loop fasteners.

8. An athletic shirt comprising: a body portion, said body portion having a back and a front and defining neck and arm openings, an elongated absorbent member, said absorbent member having a proximal and a distal end, said proximal end attached to the back at the neck opening of said body portion, said absorbent member having a rectangular configuration, said absorbent member extending freely downwardly along the back of said body portion when not in use, said absorbent member freely extending approximately the length of said body portion for ease in pulling to the front of the wearer when desired and which can be returned to the back of the wearer when released after use.

9. An athletic shirt as claimed in claim 8 wherein said absorbent member is sewn to said body portion.

10. An athletic shirt as claimed in claim 8 wherein said absorbent member is attached to said body portion by hook and loop fasteners.

11. An athletic shirt as claimed in claim 8 wherein said absorbent member is approximately the width of said neck opening.

12. An athletic shirt as claimed in claim 8 wherein said absorbent member is releasably attached to said body portion.

* * * * *